United States Patent [19]

Schmidt

[11] 4,151,682

[45] May 1, 1979

[54] THERMALLY INSULATED WINDOWS AND DOORS

[75] Inventor: Dietrich F. Schmidt, Carlisle, Pa.

[73] Assignee: Capitol Products Corporation, Mechanicsburg, Pa.

[21] Appl. No.: 751,190

[22] Filed: Dec. 14, 1976

Related U.S. Application Data

[63] Continuation of Ser. No. 544,196, Jan. 27, 1975, abandoned.

[51] Int. Cl.[2] ..... E06B 3/00

[52] U.S. Cl. ..... 49/404; 49/458; 49/501; 49/504; 49/DIG. 1

[58] Field of Search ..... 49/458, 501, 504, DIG. 1, 49/404

[56] References Cited

U.S. PATENT DOCUMENTS

| | | | |
|---|---|---|---|
| Re. 24,704 | 9/1959 | Kunkel | 49/458 X |
| 3,055,468 | 9/1962 | Horejs et al. | 49/DIG. 1 X |
| 3,324,597 | 6/1967 | Rich | 49/458 X |
| 3,420,026 | 1/1969 | Nolan | 49/DIG. 1 X |
| 3,530,618 | 9/1970 | Grossman | 49/501 |
| 3,780,473 | 12/1973 | Kort et al. | 49/DIG. 1 X |

FOREIGN PATENT DOCUMENTS

| | | | |
|---|---|---|---|
| 1961119 | 6/1971 | Fed. Rep. of Germany | 49/DIG. 1 |

*Primary Examiner*—Mervin Stein
*Assistant Examiner*—David H. Corbin
*Attorney, Agent, or Firm*—Donald L. Johnson; John F. Sieberth; Paul H. Leonard

[57] ABSTRACT

Complete thermal insulation of metal rails and stiles in vertically or horizontally sliding or rolling windows or doors is provided by including in the frame thereof centered rigid plastic shapes which extend between panels of the windows or doors. All rails and stiles of each panel are thereby exposed only to either interior or exterior ambient temperatures.

13 Claims, 9 Drawing Figures

THERMALLY INSULATED WINDOWS AND DOORS

This is a continuation of application Ser. No. 544,196, filed on Jan. 27, 1977 now abandoned.

BACKGROUND OF THE INVENTION

The present invention is in the building construction field and particularly relates to windows and doors, especially metal windows and doors employing insulated glass panels. The invention is applicable to single or double hung windows and to vertically or horizontally sliding or rolling windows or doors.

The invention particularly relates to thermally insulated windows or doors and similar panel assemblies for installation in a rough opening of an enclosing wall exposed to different temperature conditions at the opposite sides thereof.

The relatively high thermal conductivity of metals, such as aluminum, is probably the most undesirable property limiting their substitution for wood and other less conductive non-metallic structural materials. The effect of this metal characteristic is best seen in windows or doors or other panel assemblies employing metal framing in direct conductive relationship with air at interior and exterior ambient temperatures giving rise to the generation and presence of frost and moisture condensation on the interior surfaces of the framing, especially in northern climates where extreme temperature differentials prevail. When a panel assembly has a metal outer frame fixed in the rough opening of a wall and a sash or sashes movably mounted in such fixed outer frame and each having a metal frame peripherally embracing a glass or other panel, the thermal conductivity problem exists with respect to the metal sash frame as well as the metal outer or fixed frame.

A wide variety of solutions to overcome the deleterious high thermal conductivity of metal framing for windows and doors and similar panels have been proposed with varying degrees of success. Most of these have included some type of thermal break or insulating material installed in an appropriate part of the metal frame. Some of these thermal break or thermal barrier concepts have been relatively simple while others have been somewhat complex. Examples of thermal barrier window or door constructions may be found in U.S. Pat. Reissue Nos. 24,704; 3,055,468; 3,289,377; 3,302,354; 3,332,184; 3,393,487; 3,411,254; 3,462,884; 3,487,580; 3,600,857; and 3,780,473.

It is a primary object of the present invention to provide a metal thermal break or thermal barrier window or door or like construction having vertically or horizontally sliding or rolling panels wherein all metal framing members including header, jambs, sill, rails and stiles thereof are exposed either completely to interior or exterior temperatures.

Another object of the invention is to provide a thermal break panel assembly wherein no additional thermal insulation is required for sash rails or sash stiles.

Still another object of the invention is to provide a thermally insulated window, door or the like, which is structurally sound, simple of design and which can be economically manufactured.

Other objects and advantages of the instant invention will become apparent from a consideration of the descriptions and drawings hereinafter.

SUMMARY OF THE INVENTION

The present invention includes a thermally insulated metal window or door or like panel assembly wherein centered rigid plastic shapes are installed in a metal frame of the assembly to thereby provide a complete thermal barrier between exterior and interior ambient temperatures. The invention is applicable to assemblies having either vertically or horizontally sliding or rolling panels or other assemblies having movable panels, including single or double hung windows, patio doors and like constructions.

BRIEF DESCRIPTION OF THE DRAWINGS

The foregoing and other aspects and advantages of the present invention will become more readily apparent to those skilled in the art upon a full understanding of the preferred embodiments of the invention shown in the accompanying drawings wherein.

DESCRIPTION OF THE PREFERRED EMBODIMENT

Figure 1:
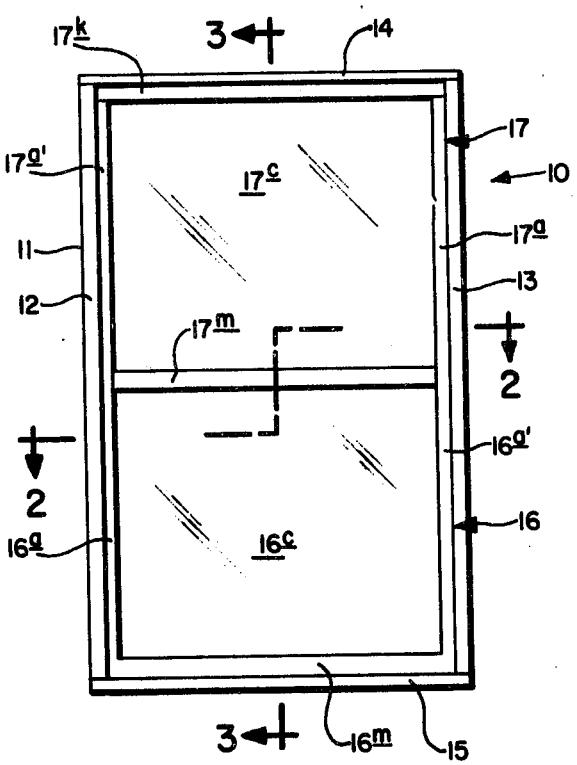
FIG. 1 is an elevational view of the exterior side of a window assembly embodying this invention.

The window, door or like panel assembly of the present invention is adapted for installation in a rough opening of a wall in a building, house, or like construction. The panel assembly is particularly adapted for use with insulated glass panels. Window assemblies may be of either the single or double hung type. Windows or doors may also be either vertically or horizontally sliding or rolling or otherwise movable. If the assembly includes only two insulated glass panels or the like, one panel may be fixed and the other movable.

The present invention provides a window or door assembly comprising an outer metal frame incorporating a thermal barrier portion insulating one side of the outer frame from the other side thereof and a plurality of window or door panels mounted within the outer frame and each panel having a continuous metal frame (as hereinafter defined), at least one of the panels being moveable in a substantially parallel manner with respect to a neighbouring panel or panels, and a thermal barrier or barriers disposed between the or each moveable panel and its/their neighbouring panel or panels and adjacent the metal panel frames such that the metal frame of each panel is thermally insulated from one side of said assembly.

As used herein the expression "continuous metal frame" means a frame which is uninterrupted metal from one side of the panel to the other and which is not broken and weakened by the inclusion of thermal break material.

In the window or door assembly of the present invention, the inclusion of thermal breaks in the panel frames is avoided. The individual panel frames used in the present invention are continuous metal frames.

The invention includes a window or door assembly comprising an outer frame for installation in an opening in a wall and including interior and exterior metal frame members for respective exposure to interior and exterior ambient temperatures and a rigid non-metallic thermal barrier member or members interlockingly engaged with the interior and exterior metal frame members and disposed therebetween so as to rigidly assembly together the metal frame members and thermally insulate them from each other, and first and second sashes or panels in an overlapping relationship within the frame and being disposed one on each side of the median of the thermal barrier member or members, at least one of the sashes or panels being moveable in a substantially parallel manner with respect to the other sash or panel so as to open and close the window or door, each of the sashes or panels including an insulated glass panel and a continuous metal frame (as hereinbefore defined) extending along and embracing the periphery of the glass panel, a rigid non-metallic thermal barrier interlock member being lockedly engaged with the metal frame of one of the sashes or panels and disposed between the metal frames of the sashes or panels, the rigid non-metallic thermal barrier member or members and the rigid non-metallic thermal barrier interlock member being shaped and disposed so as to provide a complete thermal barrier between all metal frame portions of the assembly which are exposed to the interior environment, when the assembly is in use, and all metal frame portions which are exposed to the exterior environment when the assembly is in use.

Also provided by the invention is a window or door assembly having an outer frame including interior and exterior metal frame members separated and joined together by a thermal break member, and a first and second panel in an over-lapping relationship within the frame and being disposed one on each side of the median of the thermal break member, at least one of the panels being moveable in a substantially parallel manner with respect to the other of the panels so as to open or close the window or door, and each of the panels having a continuous metal frame (as hereinbefore defined) extending around the periphery thereof, a thermal barrier member being installed on the outer frame adjacent and inwardly from the thermal break member and so constructed as to provide a complete thermal barrier between the metal frame of one panel and the metal frame of the other panel and between the metal frame of each panel and the respectively oppositely positioned metal portion of the outer frame.

A further embodiment of the invention is a window or door assembly comprising an outside frame and mounted therein at least two sashes or panels of the insulated or double glazed type, at least one of the sashes or panels being slidable or moveable in the outside frame; each of the sashes or panels having a continuous metal frame (as hereinbefore defined); the outside frame having an interior metal frame member and an exterior metal frame member and a thermally non-conductive barrier material interlockingly engaged with and connecting the interior metal frame member and the exterior metal frame member, thereby thermally insulating the interior and exterior metal frame members from each other; a thermally non-conductive barrier member mounted on the outside frame and positioned inwardly thereof and on a line extending between each of the sashes or panels thereby providing a thermal barrier between the metal frame of each of the sashes or panels and their respectively oppositely positioned interior or exterior metal frame member of the outside frame; and at least one of the meeting frame members of the continuous metal frame of one of the sashes or panels having a thermally non-conductive insulating member lockedly engaged on the meeting frame member to meet with the meeting frame member of the other of the sashes or panels and provide a thermal barrier between the metal meeting frame members of each of the sashes or panels.

Referring now to the drawings, especially FIG. 1, a double hung window as viewed from the exterior is generally illustrated at 10 and incorporates an outer frame 11 which comprises side jambs 12 and 13, connected to a header 14 and a sill 15. The side jambs, head and sill are preferably made of an extruded aluminum or aluminum alloy. The parts are held together in a conventional manner using screws or other suitable fasteners. The window 10 additionally includes a movable or vertically slidable lower sash or insulated glass panel 16 and a movable or vertically slidable upper sash or insulated glass panel 17. The upper sash may be fixed if desired, as in a single hung window. The window 10 optionally includes a screen panel (not shown) exterior of and adjacent the lower panel 16. The glass and screen panels are mounted in a conventional manner.

The header, sill and jambs or window frame members are so constructed as to provide suitable tracks for the upper and lower sash and screen panel. The frame members are of a thermal barrier or thermal break type. They are especially constructed so as to include the novel plastic or insulating thermal break shapes of the instant invention. The thermal break shapes are made of rigid plastic and extend longitudinally the length of the frame members of which they form an integral part thereof.

Figure 2:
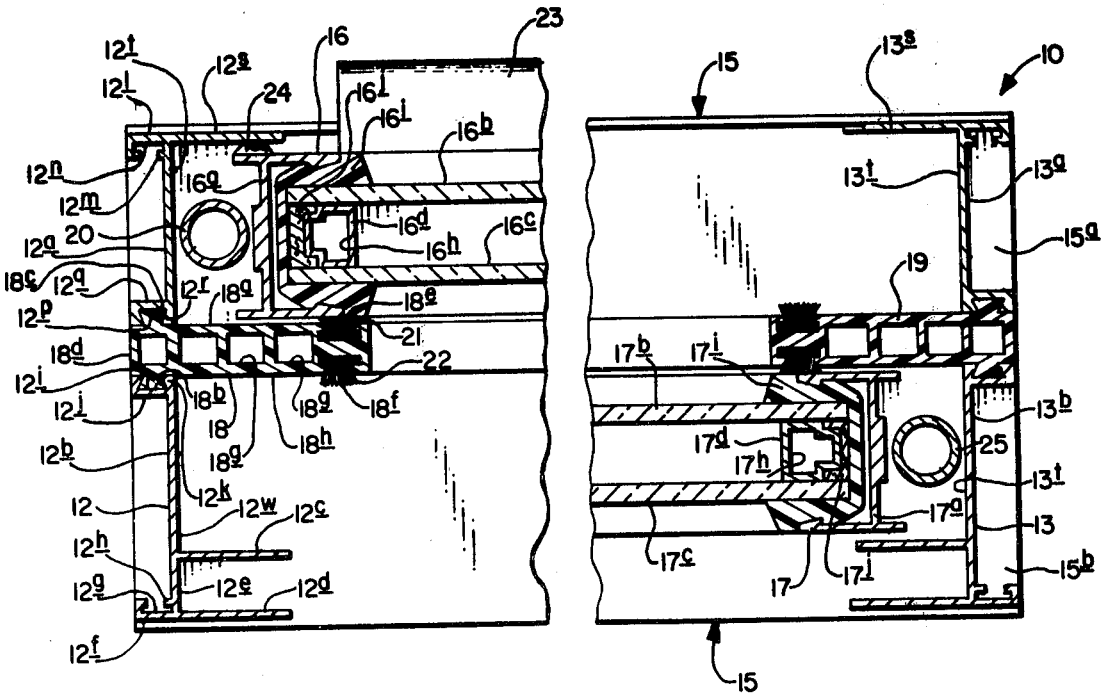
FIG. 2 is an enlarged horizontal sectional view taken along lines 2—2 of FIG. 1.
Figure 3:
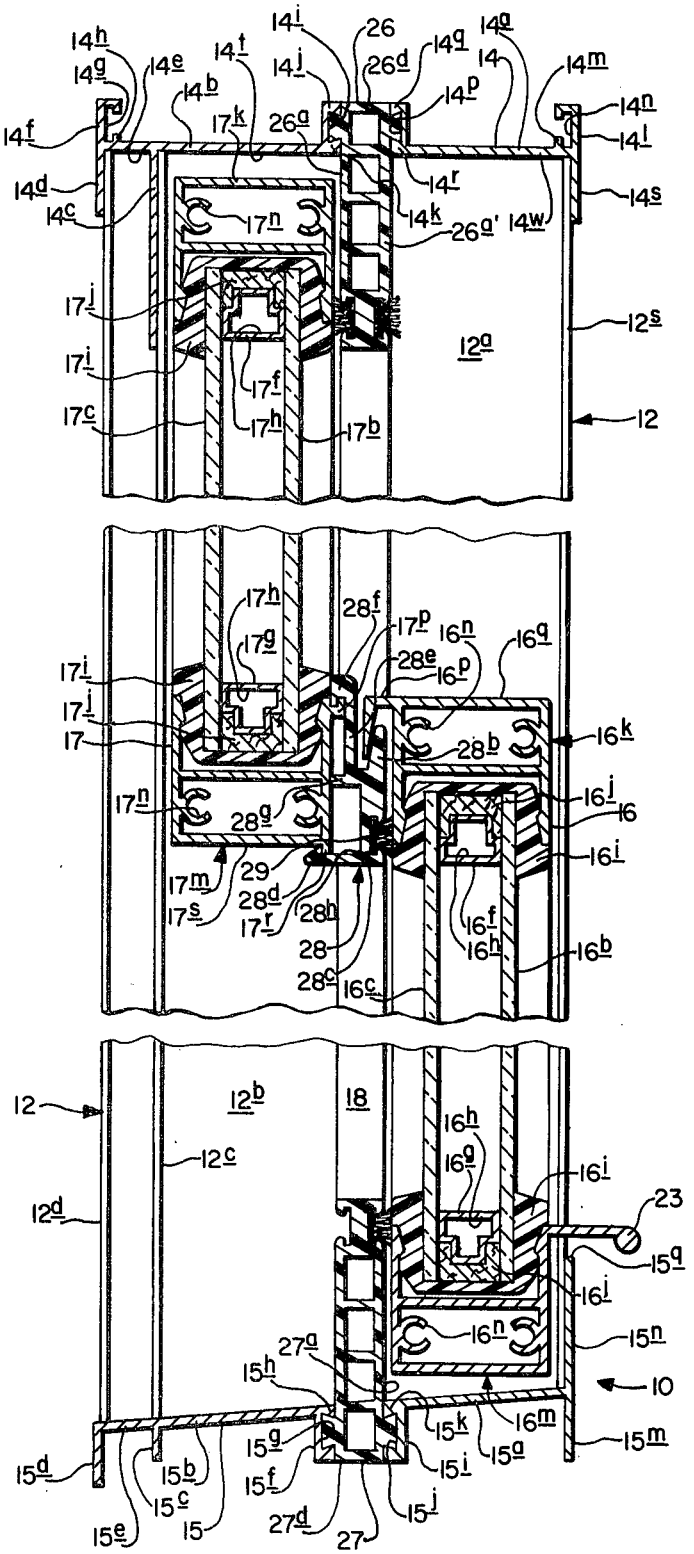
FIG. 3 is an enlarged vertical sectional view taken along lines 3—3 of FIG. 1.

Details of the window 10 are more clearly seen in FIGS. 2 and 3. The left jamb 12 and right jamb 13 are similarly constructed. The jamb 12 includes an interior metal framing member **12*a* and an exterior metal framing member 12*b* joined together by a novel rigid plastic member 18. Similarly, the jamb 13 includes an interior metal framing member 13*a* and an exterior metal framing member 13*b* joined together by a unique rigid plastic member 19**.

Members **12*c* and 12*d* extend perpendicularly and inwardly from the member 12*b* on the end thereof and form a channel 12*e* for receiving a screen sash or panel. A member 12*f* also extends perpendicularly from the end of the member 12*b* and opposite the member 12*d*. A "T"-shaped channel 12*g* is formed by the member 12*f* and a short outwardly extending perpendicular member 12*h* on the member 12*b*. A dove-tailed channel 12*i* is formed by a member 12*j*, which extends perpendicularly from the member 12*b* and parallel to the member 12*f*, and by an end portion 12*k* on the interior end of the member 12*b***.

A member 121, similar to the member **12*f***, extends perpendicularly outwardly on one end of the member 12a. A short perpendicular member 12m also extends outwardly from the member 12a and is parallel to the member 12h. A "T"-shaped channel 12n is formed by the members 121 and 12m. On the opposite end of the member 12a, a dove-tailed channel 12p is formed by a member 12q, which extends outwardly and perpendicularly from the member 12a and parallel to the member 121, and by an end portion 12r on the member 12a. A member 12s extends perpendicularly inwardly from the member 12a on the end thereof and opposite the member 121. The member 12s also extends parallel to the members 12c and 12d. The member 12s and side 18a of the plastic shape 18 form a channel 12t for receiving sash 16. The member 12a and side 18h of the plastic shape 18 form a channel 12u for receiving sash 17. A sash balance 20 of the spiral type is also positioned in the channel 12t between the member 12a and sash frame member or stile 16a and mounted in a conventional manner.

The jamb 13 is similarly constructed to the jamb 12. The insulating member 18 is a unitary rigid plastic shape which provides a complete thermal barrier between external framing member 12b and internal framing member 12a and between sash 16 and sash 17. The member 18 extends longitudinally the length of the framing member or jamb 12. The plastic member 18 has dove-tailed projections 18b and 18c extending perpendicularly and outwardly from one end of the member 18 and opposite each other and which are so constructed as to be received by dove-tailed channels 12i and 12p, respectively. The outward edge 18d of the member 18 is aligned with the outward edges of the members 12j and 12q, and members 12f and 121. A pair of "T"-shaped channels 18e and 18f are formed in the other end of the member 18 and opposite each other. A wool sash pile or pile sealing strip 21 and 22 is inserted in each of the "T"-shaped channels 18e and 18f, respectively. The sash piles serve as insulating guides for the sash panels adjacent thereto. In the embodiment of the plastic thermal insulating barrier 18 illustrated in FIGS. 2 and 3, a plurality of rectangular openings 18g are formed in the member 18.

The plastic member 18 forms a unitary jamb 12 with the external metal framing member 12b and the internal metal framing member 12a.

The plastic members 18 and 19 are similarly constructed and not only provide a thermal break between the members 12a and 12b, and 13a and 13b, respectively, but also provide a complete thermal barrier between sash panels 16 and 17.

The framing members 12a, 12b, 13a and 13b are preferably extruded aluminum shapes. The insulating members 18 and 19 are preferably extruded rigid plastic shapes. It can readily be appreciated that such framing and insulating members can be provided in a variety of designs or constructions. It being only essential that when assembled together and used in a window assembly in a wall of a building, etc., that a complete thermal barrier is created between interior and exterior ambient temperatures.

Various types of sash balances may also be used in the window assembly.

The sash or insulated glass panels can also be constructed in a variety of ways. The illustrated panels are merely examples of a type suitable for use with the present invention. Panels 16 and 17 are similarly constructed. Referring to panel 16, a pair of glass panels 16b and 16c are separated by longitudinally extending metal spacers 16d and 16e (not shown) and metal spacers 16f and 16g (FIG. 3). Normally a dessicant is placed in the opening 16h of the spacer 16d and in the openings of the other metal spacers. Spacers 16d and 16e form a rectangular frame with spacers 16f and 16g. A "U"-shaped gasket 16i is positioned externally around the edges of glass panels 16b and 16c. A sealant 16j such as a polysulfide or other suitable material is placed in the space between the metal spacers and the gasket 16i and assures complete sealing of the space between panels 16b and 16c from the exterior.

A sash frame comprising stile 16a and an opposite stile 16a' and rails 16k and 16m are positioned rectangularly around the gasket 16i. A plurality of screw bosses 16n are integrally formed on the rails 16k and 16m. Rail 16k also has an "L"-shaped interlock or stop member 16p integrally formed thereon which extends inwardly from the top member 16q. A handle 23 is integrally formed on bottom rail 16m and extends outwardly from said rail. A plurality of guide buttons 24 or insulating strips are mounted or positioned on each end of the sash 16 to guide or position the sash in channels 12t and 13t adjacent the members 12s and 13s, respectively.

The upper sash or panel 17 includes stile 17a and opposite stile 17a' and rails 17k and 17m which form a rectangular frame for receiving gasket 17i and glass panels 17b and 17c. Panels 17b and 17c are separated by spacers 17d, 17e (not shown) 17f and 17g rectangularly arranged and having openings 17h therein. A sealant 17j fills the space between the metal spacers and the gasket 17i. A plurality of screw bosses 17n are integrally formed on the rails 17k and 17m. Rail 17m also has a small "L"-shaped projection 17p extending outwardly therefrom and a short projection 17r extending downwardly from the bottom member 17s.

A sash balance 25, similar to the balance 20 is installed in the channel 13t between the framing member 13b and sash stile 17a in a customary manner.

The header 14 includes an interior framing member 14a and an exterior framing member 14b joined together by a rigid plastic shape 26. Similarly, the sill 15 includes an interior framing member 15a and an exterior framing member 15b joined together by a rigid plastic shape 27. The plastic members 26 and 27 are constructed similarly to the plastic members 18 and 19 and extend lengthwise the width of the framing members joined thereto. The shapes 26 and 27 also not only provide a thermal break between their respective framing members, but also provides a complete thermal barrier between panels 16 and 17.

Members 14c and 14d extend perpendicularly and downwardly from the member 14b on the end thereof and form a channel 14e. The member 14c is somewhat longer than the member 14d and along with side 26a of the member 26 form a channel 14t for receiving sash 17. A member 14f extends perpendicularly and upwardly from the end of the member 14b and opposite the member 14d. A "T"-shaped channel 14g is formed by the member 14f and a short upwardly extending perpendicular member 14h. A dove-tailed channel 14i is formed by a member 14j, which extends perpendicularly and upwardly from the member 14b and parallel to the member 14f, and by an end portion 14k on the interior end of the member 14b.

A member 141, similar to the member 14f, extends perpendicularly upwardly or outwardly on one end of the member 14a. A short upwardly extending perpendicular member 14m also extends outwardly from the member 14a and parallel to the member 141. A "T"-shaped channel 14n is formed by the members 141 and 14m. On the opposite end of the member 14a, a dove-tailed channel 14p is formed by a member 14q, which extends perpendicularly upwardly from the member 14a and parallel to the member 141, and by an end portion 14r on the member 14a. A member 14s extends perpendicularly and downwardly from the member 14a on the end thereof and opposite the member 141. The member 14a also extends parallel to the members 14c and 14d. The member 14s and side 26a' of the plastic shape 26 form a channel 14u for receiving sash 16 when in a raised position. The outward edge 26d of the shape 26 is aligned with the outward edges of the members 14j and 14q, and members 14f and 141.

Referring to the sill 15, the members 15c and 15d extend downwardly and approximately perpendicularly from the member 15b on one end thereof and parallel to each other. The member 15c is somewhat shorter than the flange 15d and forms a channel 15e with the member 15d. A member 15f extends approximately perpendicularly downwardly from the other end of the member 15b and parallel to the members 15c and 15d. A dove-tailed channel 15g is formed by the member 15f and by an end portion 15h on the interior end of the member 15b.

A member 15i, similar to the member 15f, extends approximately perpendicularly and downwardly from the member 15a. A dove-tailed channel 15j is formed by the member 15i and an end portion 15k of the member 15a. The channels 15g and 15j are adapted to receive dove-tailed constructions on the end of the plastic shape 27. A flange 15m extends downwardly and approximately perpendicularly from the other end of the member 15a and is parallel to the member 15c and 15d. A flange 15n extends approximately perpendicularly and upwardly from the end of the member 15a and opposite the member 15m. The member 15n and side 27a of the plastic shape 27 form a channel 15p for receiving sash 16. One side or end 15q of the flange 15n provides a stop for the handle 23 on the sash rail 16m. The outer edge 27d of plastic shape 27 is aligned with the outer edges of the members 15f and 15i and members 15c and 15m. The alignment of such members permits the sill 15 to be installed on a flat surface. The sill 15 is also so constructed as to provide a downward slope from the interior end thereof to the exterior end thereof.

The header 14 and sill 15 can be constructed in a variety of shapes. Such constructions should, however, provide for a complete thermal break between exterior and interior framing members and for a complete thermal barrier between sashes 16 and 17.

A snap-on insulating interlock member or plastic shape 28 is positioned or mounted on rail 17m of the sash 17. The member 28 is preferably an extruded or molded plastic shape and provides an insulating barrier between sashes 16 and 17. It can be appreciated that the member 28 can be constructed in a variety of shapes. It is only necessary that it provide a complete thermal barrier between sash 16 and sash 17 and be attached to one of the sashes so as to be movable therewith.

As illustrated in FIG. 3, the plastic shape 28 includes a main member 28a having a somewhat triangular shaped end 28b which forms an interlock with the member 16p thereby limiting or stopping the travel of the sashes 16 and 17 in relation to each other, but permitting the sash 17 to be lowered. A flange 28c extends perpendicularly from the lower end of the member 28a and has a hooked member 28d on the end thereof for lockedly engaging short projection member 17r on the rail 17m. A member 28e extends perpendicularly from the member 28a a short distance therefrom and then upwardly parallel thereto. A foot member 28f is formed on the end of the member 28e and lockedly engages "L"-shaped projection 17p on the rail 17m. A short member 28g extends perpendicularly from the member 28a towards the sash 17 and adjacent rail 17m. A "T"-shaped channel 28h is formed in the end of the member 28a facing sash 16 and is adapted to receive a wool sash pile or insulating strip 29.

Figure 4:
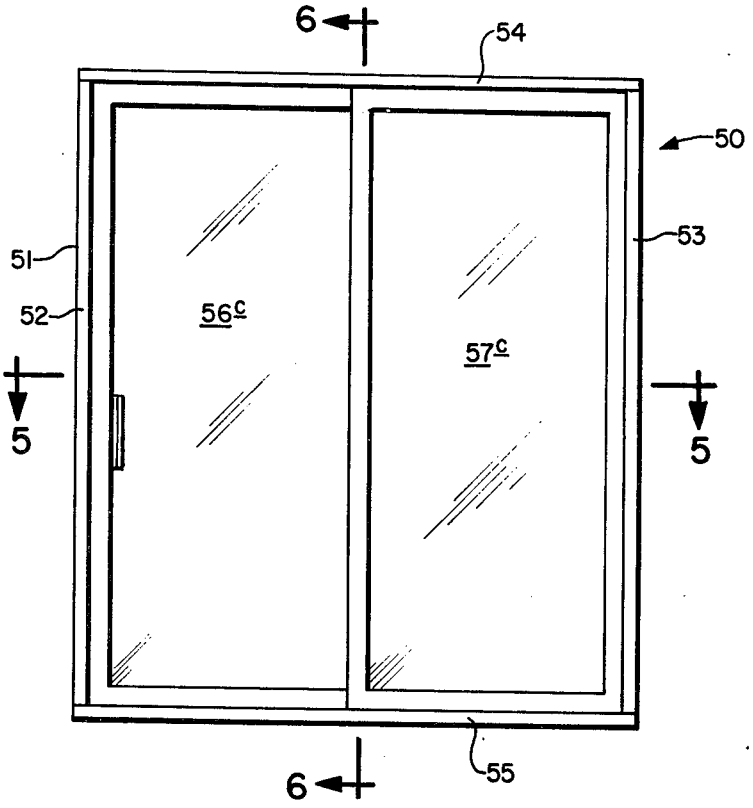
FIG. 4 is an elevational view of the exterior side of a door assembly according to another embodiment of this invention.
Figure 5:
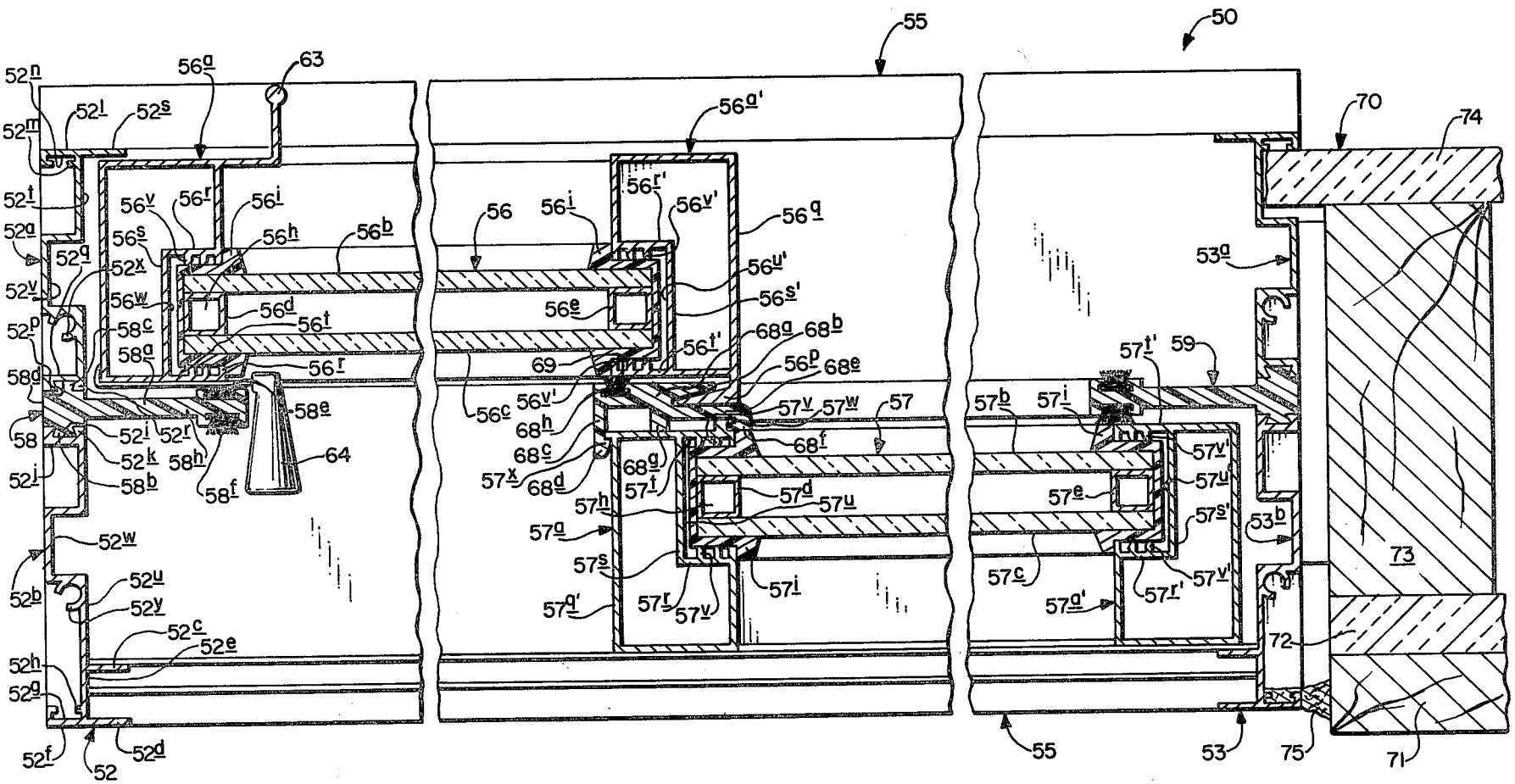
FIG. 5 is an enlarged horizontal sectional view taken along the line 5—5 of FIG. 4.
Figure 6:
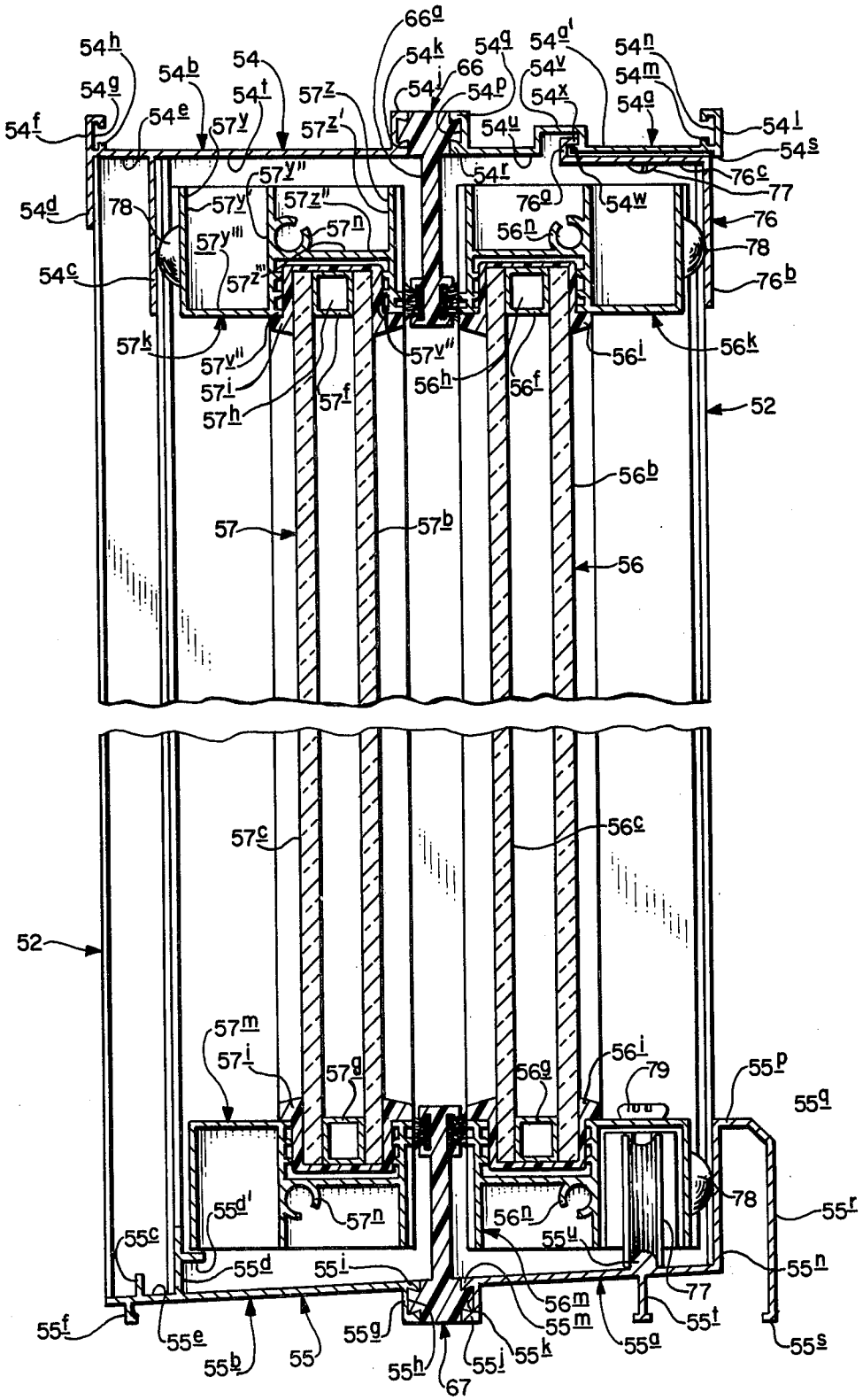
FIG. 6 is an enlarged vertical sectional view taken along the line 6—6 of FIG. 4.

Referring now to FIGS. 4–6 of the drawings, a patio door or horizontal sliding door is illustrated generally at 50. The door 50 is illustrated as being viewed from the exterior and incorporates an outer frame 51 which comprises side jambs 52 and 53, connected to a header 54 and a sill 55. The side jambs, head and sill are preferably made of an extruded aluminum or aluminum alloy. The various frame members are held together in a conventional manner using screws or other suitable fasteners. The door or door assembly 50 additionally includes a movable or horizontally slidable insulated glass panel 56. Glass panel 57 is illustrated as being in a fixed position, but can be movable if desired. The door 10 optionally includes a screen panel (not shown) exterior of and adjacent interior panel 56 and slidable adjacent panel 57. The glass and screen panels are mounted in a conventional manner.

As in the case of the window, the header, sill and jambs or frame members are so constructed as to provide suitable tracks for the glass and screen panels. The frame members are of a thermal barrier or thermal break type. They are especially constructed so as to include the novel plastic or insulating thermal break shapes of the instant invention. The thermal break shapes are made of rigid plastic and extend longitudinally the length of the frame members of which they form an integral part thereof.

Details of the door 50 are more clearly seen in FIGS. 5 and 6. The left jamb 52 and right jamb 53 are similarly constructed and as illustrated are identical. The jamb 52 includes an interior framing member 52a and an exterior metal framing member 52b joined together by a novel rigid plastic member 58. Similarly, the jamb 53 includes an interior metal framing member 53a and an exterior metal framing member 53b joined together by a unique rigid plastic member 59.

It can be appreciated that the side framing members 52 and 53 may be constructed of various shapes as desired. It is essential, however, that such framing members be of the thermal break type and that the plastic shapes or insulating members 58 and 59 provide a thermal break between their respective interior and exterior framing members and also a complete thermal barrier between the panels 56 and 57.

Referring to the left jamb or framing member 52, members 52c and 52d extend perpendicularly and inwardly from the member 52b on the end thereof and form a channel 52e for receiving a screen panel. A flange or member 52f also extends perpendicularly and outwardly from the end of the member 52b and opposite the member 52d. A "T"-shaped channel 52g is formed by the member 52f and a short perpendicular member 52h extending outwardly from the member 52b. A dove-tailed channel 52i is formed by a member 52j, which extends perpendicularly and outwardly from the member 52*b* and parallel to the member 52*f*, and by an end portion 52*k* on the interior end of the member 52*b*.

A member 521, similar to the member 52*f*, extends perpendicularly outwardly on one end of the member 2*a*. A short perpendicular member 52*m* also extends outwardly from the member 52*a* and is parallel to the member 521. A "T"-shaped channel 52*n* is formed by the members 521 and 52*m*. On the opposite end of the member 52*a*, a dove-tailed channel 52*p* is formed by a flange or member 52*q*, which extends perpendicularly and outwardly from the member 52*a* and parallel to the member 521, and by an end portion 52*r* on the member 52*a*. A member 52*s* extends perpendicularly and inwardly from the member 52*a* on the end thereof and opposite the member 521. The member 52*s* also extends parallel to the members 52*c* and 52*d*. The members 52*s* and side 58*a* of the plastic shape 58 form a channel 52*t* for receiving panel 56. The member 52*c* and side 58*h* of the plastic shape 58 form a channel 52*u* for receiving panel 57. The members 52*a* and 52*b* also have "U"-shaped channels 52*v* and 52*w*, respectively, formed therein. Screw bosses 52*x* and 52*y* are also formed respectively, in the members 52*a* and 52*b*.

The insulating member 58 is a unitary rigid plastic shape which provides a complete thermal barrier between external framing member 52*b* and interior framing member 52*a* and between panel 57 and panel 56. The member 58 extends longitudinally the length of the framing member or jamb 52. The plastic member 58 has dove-tailed projections 58*b* and 58*c* extending perpendicularly outwardly from one end thereof and opposite each other and which are so constructed as to be received by the dove-tailed channels 52*i* and 52*p*, respectively. The outward edge 58*d* of the member 58 is aligned with the outward edges of the members 52*q* and 52*j*. The outward edge 58*d* is also aligned with the outer edges of "U"-shaped channels 52*v* and 52*w* and the outer edges of the members 52*f* and 52*l*.

A pair of "T"-shaped channels 58*e* and 58*f* are formed on the other end of the member 58 and opposite each other. Wool sash piles or pile sealing strips 61 and 62 are inserted in the "T"-shaped channels 58*e* and 58*f*, respectively. The sash piles serves as insulating guides for the panels adjacent thereto. In the embodiment of the plastic thermal insulating barrier 58 illustrated in FIGS. 5, 6, and 7, the shape 58 is a one-piece plastic shape with "T"-shaped channels 58*e* and 58*f* and dove-tailed projections 58*b* and 58*c* formed therein.

The plastic member 58 forms a unitary jamb 52 with the external framing member 52*b* and the internal framing member 52*a*. The plastic members 58 and 59 are identical and not only provide a thermal break between the members 52*a* and 52*b*, and 53*a* and 53*b*, respectively, but also provide a complete thermal barrier between panels 56 and 57.

The framing members 52*a*, 52*b*, 53*a* and 53*b* are preferably extruded aluminum shapes. The insulating members 58 and 59 are preferably extruded rigid plastic shapes. Such plastic shapes may, of course, also be molded.

A portion of a wall 70 in which the door assembly 50 is positioned therein is illustrated in FIG. 5. The wall 70 comprises exterior wood siding 71 or alternatively brick, a wall board 72 mounted on the stud 73 and an interior dry wall 74 also mounted on the stud 73. Suitable caulking 75 is placed in the space between the wall 70 and the door assembly 50.

The door or insulated glass panel may also be constructed in a variety of ways. The illustrated panels are merely examples of a type suitable for use with the present invention. Panels 56 and 57 are similar. Referring to panel 56, a pair of glass panels 56*b* and 56*c* are separated by longitudinally extending metal spacers 56*d* and 56*e* and metal spacers 56*f* and 56*g* (FIG. 6). Normally a dessicant is placed in the opening 56*h* of the spacer 56*d* and in the openings of the other metal spacers. Spacers 56*d* and 56*e* form a rectangular frame with spacers 56*f* and 56*g*. A "U"-shaped glazing gasket 56*i* is positioned externally around the edges of glass panels 56*b* and 56*c*. The gasket 56*i* assures complete sealing of the space between glass panels 56*b* and 56*c* from the exterior.

A panel frame comprising the stiles or framing members 56*a* and 56*a*' and rails 56*k* and 56*m* is positioned rectangularly around the gasket 56*i*. Screw bosses 56*n* are integrally formed on the rails 56*k* and 56*m*. Stile 56*a*' also has an "L"-shaped interlock or stop member 56*p* integrally formed thereon which extends inwardly from the top member 56*q*. A handle 63 is integrally formed on stile 56*a* and extends inwardly and perpendicularly from said stile. Stiles 56*a* and 56*a*' are of a somewhat "L"-shaped tubular construction. Members 56*r*, 56*s*, and 56*t* and members 56*r*', 56*s*', and 56*t*' form channels 56*u* and 56*u*', respectively, for receiving the "U"-shaped gasket 56*i*. A plurality of short projection members 56*v* and 56*v*' extend inwardly from their respective members 56*r* and 56*r*', and inwardly from their respective members 56*t* and 56*t*', for engaging the gasket 56*i*. An exterior handle 64 is also mounted on the stile 56*a* by any suitable manner such as screws or bolts.

The other panel 57 includes stiles 57*a* and opposite stile 57*a*' and rails 57*k* and 57*m* which form a rectangular frame for receiving gasket 57*i* and glass panels 57*b* and 57*c*. Panels 57*b* ad 57*c* are separated by spacers 57*d* and 57*e* and spacers 57*f* and 57*g*, rectangularly arranged and having openings 57*h* therein. Preferably, a dessicant is placed in the openings 57*h* of the metal spacers. A "U"-shaped glazing gasket 57*i* is mounted externally around the periphery of glass panels 57*b* and 57*c*. The gasket 57*i* completely seals the space between glass panels 57*b* and 57*c* from the exterior.

A panel frame comprising stiles or framing members 57*a* and 57*a*' and rails or framing members 57*k* and 57*m* is mounted rectangularly around the gasket 57*i*. Screw bosses 57*n* are integrally formed on the rails 57*k* and 57*m*. Stile 57*a* also has a small "L"-shaped projection 57*w* extending outwardly therefrom and a short projection 57*x* extending outwardly from the member 57*q*'.

Stiles 57*a* and 57*a*' are of a somewhat "L"-shaped tubular construction. Members 57*r*, 57*s* and 57*t* and members 57*r*', 57*s*' and 57*t*' form channels 57*u* and 57*u*', respectively, for receiving the "U"-shaped gasket 57*i*. A plurality of short projection members 57*v* and 57*v*' extend inwardly from their respective members 57*r* and 57*r*', and inwardly from their respective members 57*t* and 57*t*', for engaging the gasket 57*i*.

A snap-on insulating interlock member or plastic shape 68, similar to shape 28 but of a somewhat heavier or sturdier construction is positioned or mounted on stile 57*a*. The member 68 provides an insulating barrier between panels 56 and 57. The member 68 can also be manufactured in a variety of shapes. It is only necessary that the member 68 provide a complete thermal barrier between panels 56 and 57. As illustrated in FIG. 5, the plastic shape 68 includes a main member 68*a* having a somewhat triangular shaped end 68b on one end thereof which forms an interlock with the member 56p thereby limiting or stopping the travel of the panels 56 and 57 in relation to each other, but permitting the panel 56 to move horizontally toward frame 53. A flange 68c extends perpendicularly from the other end of the member 68a and has a hooked member 68d on the end thereof for lockedly engaging short projection member 57x on the stile 57a. A member 68e extends perpendicularly from the member 68a and then outwardly parallel thereto. A foot member 68f is formed on the end of the member 68e and lockedly engages "L"-shaped projection member 57w on stile 57a. A short member 68g extends perpendicularly from the member 68a towards the panel 57 and adjacent stile 57a. A "T"-shaped channel 68h is formed in the end of the member 68a facing panel 56 and is adapted to receive a wool sash pile or insulating strip 69.

The top framing member or header 54 includes an interior framing member 54a and an exterior framing member 54b joined together by a rigid plastic shape 66. Similarly, the bottom framing member or sill 55 includes an interior framing member 55a and an exterior framing member 55b joined together by a rigid plastic shape 67. The plastic members 66 and 67 are constructed identically to the plastic members 58 and 59 and extend lengthwise the width of the framing members joined thereto. The plastic shapes 66 and 67 also not only provide a thermal break between their respective framing members, but also provide a complete thermal barrier between panels 56 and 57.

Members 54c and 54d extend perpendicularly and downwardly or inwardly from the member 54b on the end thereof and form a channel 54e. The member 54c is somewhat longer than the member 54d and along with side 66a of the member 66 form a channel 54t for receiving panel 57. A member 54f extends perpendicularly and outwardly from the end of the member 54b and opposite the member 54d. A "T"-shaped channel 54g is formed by the member 54f and a short upwardly perpendicular member 54h on the member 54b. A dovetailed channel 54i is formed by a member 54j, which extends perpendicularly and outwardly from the member 54b and parallel to the member 54f, and by an end portion 54k on the interior end of the member 54b.

A member 541, similar to the member 54f, extends perpendicularly and outwardly on one end of the member 54a. A short perpendicular member 54m also extends outwardly from the member 54a and parallel to the member 541. A "T"-shaped channel 54n is formed by the members 541 and 54m. On the opposite end of the member 54a, a dove-tailed channel 54p is formed by a member 54q, which extends perpendicularly and upwardly from the member 54a and parallel to the member 541, and by an end portion 54r on the member 54a. A short member 54s extends perpendicularly and downwardly from the member 54a on the end thereof and opposite the member 541. The member 54s also extends parallel to the members 54c and 54d. A "U"-shaped portion 54v is formed on the member 54a between the members 54q and 541. The member 54a', which joins the "U"-shaped portion 54v and projection member 54m together has a short projection member 54w thereon which extends into the opening of the "U" to thereby form a recess or channel 54x.

The member 54s and side 66h of the plastic shape 66 form an opening or channel 54u for receiving panel 56. An angle member 76 having an "L"-shaped projection 76a on one end thereof is fastened to the member 54a by screws or bolts 77 or other suitable fastening devices. The member 76a is adapted to be received by and positioned in the channel 54x. One side 76b of the angle member 76 extends parallel to the member 54c and is approximately the same length thereof. The side member 76c of the member 76 is of a length sufficient to form an interlock with the channel 54x and to be positioned interiorly of the projection member 54s on the member 54a.

Referring to the bottom framing member or sill 55, a short member 55c extends upwardly and approximately perpendicularly from the member 55b near the end thereof. A somewhat longer member 55d also extends upwardly and perpendicularly from the member 55b and is parallel to the member 55c and forms a channel 55e therewith. A short member 55d' extends perpendicularly and horizontally inwardly from the member 55d. The top of the member 55d' provides a rest for the bottom rail 57m of the panel 57. A short "L"-shaped member 55f extends downwardly and approximately perpendicularly from the member 55b at a position intermediate of the end of the member 55b and the projection 55c. A member 55g extends approximately perpendicularly and downwardly from the other end of the member 55b and parallel to the member 55f. A dovetailed channel 55h is formed by the member 55g and by an end portion 55i on the interior end of the member 55b.

A member 55j, similar to the member 55g, extends approximately perpendicularly and downwardly from the member 55a. A dove-tailed channel 55k is formed by the member 55j and an end portion 55m of the member 55a. A member 55n extends upwardly and approximately perpendicularly from the other end of the member 55a. A short member 55p extends outwardly and approximately perpendicularly from the member 55n and a short member 55q extends downwardly at approximately a 45° angle from the member 55p. A member 55r extends downwardly from the member 55q and approximately parallel to the member 55n. A foot member 55s is formed on the end of the member 55. A "T"-shaped member 55t extends downwardly and approximately perpendicularly from the member 55a at an intermediate position between the members 55j and 55n of the member 55a. A rounded projection or member 55u extends upwardly from the member 55a opposite the member 55t. Such projection 55u provides a track for rollers 77' mounted on panel 56. The sill 55 is so constructed that the bottom of the "L" of the member 55f, the bottoms of the members 55g and 55k and the top of the "T" bar of the member 55t and the bottom of the foot member 55s are all in alignment so as to rest on a flat surface.

The sill 55 is so constructed as to provide a downward slope extending from interior end of framing member 55a to the exterior end of framing member 55b. It can be appreciated that the sill 55 may be constructed in a variety of designs or shapes. It being only essential that a complete thermal break be provided between exterior and interior framing members 55b and 55a and that a complete thermal barrier be provided between panels 56 and 57.

The top rails 57k and 56k and bottom rails 57m and 56m are similarly constructed. Referring to FIG. 6 and panel 57, it is seen that the rail 57k basically comprises a "U"-shaped or channel member 57y and an "H"-shaped or double channel member 57z adjacent each other. A member 57y' forms one side of the "U", a member 57y'' forms the other side of the "U" and the two members are joined together at one end by member 57y''' which forms the bottom of the "U". The member 57y'' also forms one side of the "H" of the member 57z. The other side of the "H" is formed by the member 57z', with the member 57z'' positioned between the members 57y'' and 57z' at an intermediate position thereon to complete the "H". The screw boss 57n is formed in the channel 57z''' at the junction of the members 57y'' and 57z'. A plurality of short perpendicular projections 57v'' extend outwardly from the member 57y'' and inwardly from the member 57z' into the channel 57u''. The channel 57u'' is adapted for receiving the glazing gasket 57i. Projections 57v'' also extend into contact with the glazing gasket 57i. A plurality of guide buttons or insulating strip 78 are mounted on the exterior side of the member 57y' by an suitable means and adjacent the interior side of the member 54c. Similarly, guide buttons 78 are mounted on top rail 56k adjacent member 76b and on bottom rail 56m adjacent member 55n.

Rollers 77' are mounted on bottom rail 56m by any suitable means such as screws or bolts 79. Other means for sliding or moving the panels may be employed if desired.

It can be appreciated that the particular construction employed in framing or otherwise manufacturing the panels 56 and 57 is illustrative only and such construction may be varied as desired.

Figure 7:
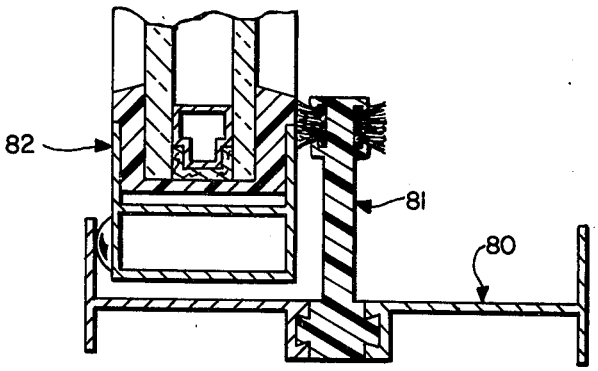
FIG. 7 is an enlarged partial sectional view illustrating one type of thermal break shape of the present invention.

A portion of a simple framing member 80 illustrating a preferred plastic shape 81 installed therein and the relationship of a panel 83 to a framing member 80 and plastic shape 81 is illustrated in FIG. 7. Plastic shape 81 is identical to plastic shapes 58, 59, 66 and 67 of FIGS. 5 and 6.

Figure 8:
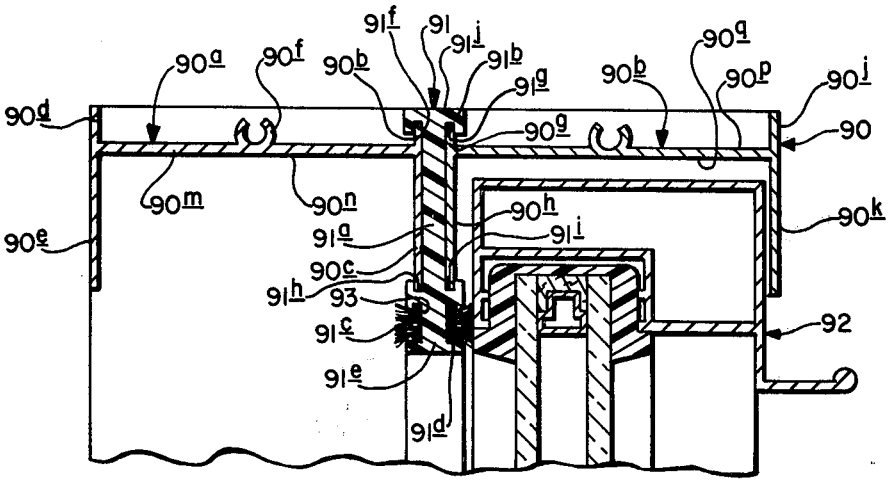
FIG. 8 is an enlarged partial sectional view illustrating another type of thermal break shape of the instant invention.

In FIG. 8 an alternative type of framing member 90 illustrating an alternate type of plastic shape 91 of the instant invention is illustrated. A segmented portion of a panel 92 is also shown illustrating the relationship of the panel 92 to the framing member 90 and the thermal break plastic shape 91. The framing member 90 includes a pair of metal framing members 90a and 90b joined together by plastic shape 91 to form a thermal break between the members 90a and 90b. The members 90a and 90b are identically formed.

The member 90a has a short upwardly extending flange 90b on the interior end thereof and a longer downwardly extending flange 90c on the same end thereof and opposite the flange 90b. An upwardly extending flange 90d and a downwardly extending flange 90e are formed on the other or exterior end of the member 90a. Flanges 90d and 90e are opposite each other and parallel to flanges 90b and 90c, respectively. Flange 90d is somewhat longer than flange 90b and flange 90e is longer than either and about the same length as flange 90c. A screw boss 90f is formed on the member 90a between flanges 90d and 90b.

The framing member 90b has an upwardly extending flange 90g and a downwardly extending flange 90h formed on the interior end thereof. Flange 90g is of the same length as flange 90b and is parallel thereto. Flange 90h is the same length as flanges 90c and is parallel thereto.

The plastic shape 91 is a one-piece construction. It comprises a body member 91a having a "T"-shaped member 91b on one end thereof and a pair of "T"-shaped channels 91c and 91d formed in an enlarged opposite end 91e thereof. "T"-shaped end member 91b has a pair of channels or grooves 91f and 91g adapted to receive the upper flange 90b of the member 90a, and upper flange 90g of the member 90b, respectively. The enlarged end 91d has a pair of channels or grooves 91h and 91i formed therein for receiving the end of flange 90c and the end of flange 90h, respectively. Preferably, the metal members 90a and 90b are joined to plastic shape 91 by sliding engagement with the interior flanges of the metal shapes being fitted into their respective channels or grooves in the plastic shape.

A sash pile 93 is inserted in each of the channels 91c.

Upwardly extending flange 90j on the member 90b is of the same length as flange 90d and is parallel thereto. The ends of said flanges are in alignment with the end side 91j of plastic shape 91. Downwardly extending flange 90k is of the same length as flange 90e and is parallel thereto. Flanges 90e and 90c and joining member 90m form a channel 90n for receiving a panel. Flanges 90h and 90k and joining member 90b form a channel 90q for receiving panel 92.

The embodiment of the invention as illustrated in FIG. 8 provides an easily constructed and readily assembleable unitary framing member for use with window or door panels. A complete thermal barrier between all metal parts to be exposed to exterior temperatures and to all metal parts to be exposed to interior temperatures is achieved.

Figure 9:
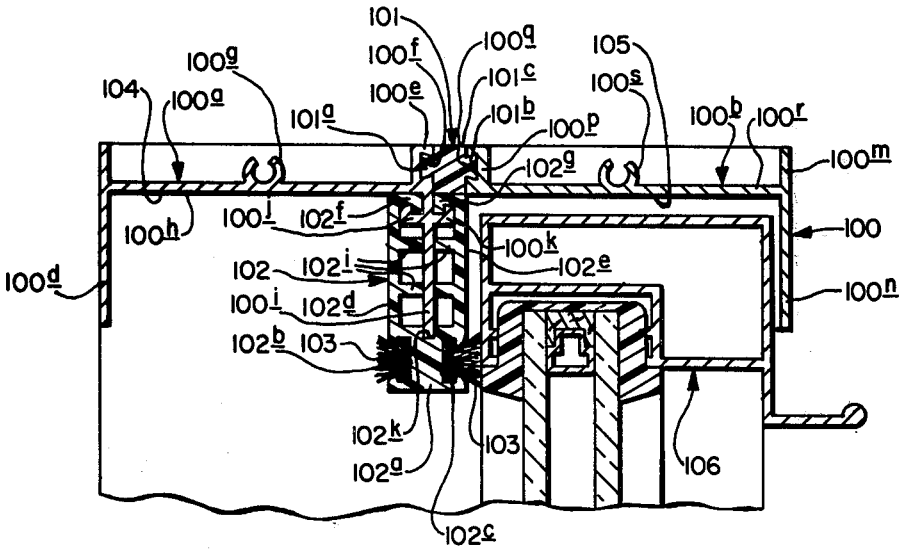
FIG. 9 is a view similar to that of FIG. 8, but illustrating still another form of a thermal break shape of the invention.

FIG. 9 illustrates an embodiment of the invention which is adapted for use with any type of thermal break construction suitable for use in a framing member. Framing member 100 shows a simple and easily manufactured window or door framing member having an external metal member 100a and an internal metal member 100b joined together by an insulating member 101 of a common type. The insulating member 101 is shown as being of a "Maltese" cross configuration in cross-section and can be made from rigid or foamed plastic, hard rubber or any other suitable type of insulating material. The complete thermal barrier between exterior metal parts and interior metal parts is accomplished by providing a novel snap-on plastic shape 102 which is mounted on metal member 100a adjacent thermal break member 101.

Framing member 100a has a short upwardly extending flange 100c on one end thereof and a longer downwardly extending flange 100d on said one end and opposite said flange 100c. An upwardly extending flange 100e, having a dove-tailed channel 100f formed therein, extends from the other end of the member 100a. A screw boss 100g is formed on the member 100h which joins flanges 100c and 100e together and between said flanges.

A downwardly extending flange 100i is formed on the interior end of the member 100a and opposite flange 100e. Flange 100i also extends parallel to flange 100d. A pair of "L"-shaped members 100j and 100k extend perpendicularly from the flange 100i and opposite each other.

Metal framing member 100b has a short upwardly extending flange 100m on the exterior end thereof and which extends parallel to the flange 100c and is the same length thereof. A longer downwardly extending flange 100n is formed on the exterior end of the member 100b and opposite flange 100m. Flange 100n extends parallel to flange 100d and is of the same length thereof.

A flange 100p extends upwardly from the interior end of member 100b and has a dove-tailed channel 100q formed therein. The flange 100p is parallel to and opposite the flange 100e. Dove-tailed channels 100f and 100q are so constructed as to receive dove-tailed projections 101a and 101b, respectively, of the insulating member 101.

The exterior edges of the flange 100c, 100e, 100p and 100m are in alignment with each other and with the outer edge 101c of the member 101. The interior edge 101d of the thermal break 101 is in alignment with the interior sides of metal members 100h and 100r. Member 100r joins flanges 100p and 100m (and also 100n) together. A screw boss 100s is formed on the member 100r between flanges 100p and 100m.

Plastic shape 102 is a rigid one-piece construction. It may be extruded or moulded or otherwise constructed as preferred. Plastic shape 102 has a rectangular end portion 102a in which a pair of "T"-shaped channels 102b and 102c are formed therein opposite each other. Such channels are adapted to receive sash piles 103.

A pair of legs 102d and 102e extend from end portion 102a in a spaced apart parallel relationship. "L"-shaped flanges 102f and 102g extend inwardly from the ends of leg members 102d and 102e, respectively and toward each other. The "L"-shaped members 102f and 102g are adapted to be lockingly engaged on "L"-shaped members 100j and 100k, respectively.

A groove or channel 102h is formed in the end portion 102a for receiving the end of metal flange 100i. A plurality of short projection members 102i extend inwardly from legs 102d and 102e so as to rest on flange 100i. The shape 102 may be slidably engaged on the flange 100i or if sufficiently flexible may be snapped on the flange 100.

Flange 100d, joining member 100h and plastic leg 102d form a channel 104 for receiving a panel. Flanges 100n, joining member 100r and plastic leg 102e form a channel 105 for receiving panel 106.

The foregoing disclosure and description of the invention is merely illustrative thereof and variations in the size, shape and materials as well as in the details of the illustrated constructions, may be made within the scope of the appended claims without departing from the spirit of the invention.

What is claimed is:

1. A metal framed window or door assembly of the type having an outside frame and mounted therein at least two sashes or panels of the insulated or double glazed type, at least one of which such sashes or panels is slidable or movable in the outside frame; each of said sashes or panels having a continuous peripheral outer metal frame; said outer metal frame of each of said panels comprising a plurality of metal frame members suitably joined together to form said outer metal frame, and one of said metal frame members of each of said panels being a meeting frame member; said outside frame comprising a plurality of thermal break frame members suitably joined together to form said outside frame, each of said thermal break frame members comprising an interior metal frame member and an exterior metal frame member and a thermally non-conductive barrier material interlockingly engaged with and connecting said interior metal frame member and said exterior metal frame member, thereby thermally insulating said interior and exterior metal frame members from each other; a thermally non-conductive barrier member mounted on said outside frame adjacent said interlocking thermally non-conductive barrier extending material and extending lineally therewith, and said barrier member inwardly of said outside frame and on a line extending between each of said sashes or panels thereby providing a thermal barrier between the metal frame of each of said sashes or panels and their respectively oppositely positioned interior or exterior metal frame member of said outside frame; and at least one of the meeting frame members of said continuous peripheral outer metal frame of one of said sashes or panels having a thermally non-conductive insulating member lockedly engaged on said meeting frame member and extending lineally therewith to meet with the meeting frame member of the other of said sashes or panels and provide a thermal barrier between the metal meeting frame members of each of said sashes or panels.

2. A metal framed window or door assembly according to claim 1, wherein said thermally non-conductive barrier material is a unitary plastic shape having a portion thereof providing a thermal barrier between interior and exterior metal frame members in said outside frame and another portion thereof extending inwardly therefrom providing a thermal barrier between said continuous peripheral outer metal frame members of each sash or panel and their respectively oppositely positioned interior or exterior metal frame member of said outside frame.

3. A metal framed window or door assembly according to claim 1, wherein said thermally non-conductive barrier material between said interior and exterior metal frame members of said outside frame is one component and said thermally non-conductive barrier member between the metal frame members of each of said sashes or panels and their respectively oppositely positioned interior or exterior metal frame member of said outside frame is another component.

4. A metal framed window or door assembly according to claim 3, wherein said outside frame has an inwardly projecting metal member for lockedly engaging said another thermal non-conductive barrier member component, and said another thermally non-conductive barrier member component is lockedly engaged on said inwardly projecting member.

5. A metal framed window or door assembly according to claim 1, wherein said thermally non-conductive insulating member lockedly engaged on said meeting frame member of said one of said sashes or panels is a unitary plastic shape.

6. A metal framed window or door assembly according to claim 1, comprising means on said meeting frame member of said one of said sashes or panels for lockedly engaging said lockedly engaged thermally non-conductive insulating member thereon, and complimentary means on said lockedly engaged thermally non-conductive insulating member for lockedly engaging said first named means.

7. A metal framed window or door assembly according to claim 1, wherein said inwardly positioned thermally non-conductive barrier member on said outer frame has a means thereon for receiving a sash pile on a face thereof and a means thereon for receiving a sash pile on the opposite face thereof.

8. In a window or door assembly having an outer frame including interior and exterior metal frame members separated and joined together by a thermal break member, and a first and second insulated glass panel in lapping relation within said outer frame and said panels being disposed in inboard and outboard relation to the median of said thermal break member, and at least one of said panels being movable in parallel relation to the other of said panels for opening or closing the window or door and each of said panels having a continuous outer metal frame extending around the periphery thereof, the improvement wherein a thermal barrier insulating member is lockedly engaged on a continuous outer metal frame member of one of said insulated glass panels adapted to meet with a continuous outer metal frame member of the other of said insulated glass panels and wherein a thermal barrier member is installed on said outer frame of said window or door assembly, extends lineally therewith and extends inwardly from said thermal break member a sufficient distance to provide a complete thermal barrier between the continuous metal frame members of one insulated glass panel and their respective oppositely positioned interior or exterior metal frame member of said outer frame.

9. A window or door assembly according to claim 8, wherein said thermal break member and said thermal barrier member are a single unitary rigid plastic shape.

10. A window or door assembly according to claim 8, wherein said thermal barrier member is a separate unitary plastic shape and has means thereon for engaging a metal projection member on said outer frame and said outer frame has a metal projection member thereon for engaging said thermal barrier member.

11. A window or door assembly according to claim 8, wherein said thermal barrier member has means thereon for lockedly engaging sash piles to be disposed between said insulated glass panels.

12. A window or door assembly comprising an outer frame to be installed in a rough opening in an enclosing wall and including interior and exterior metal frame members for respective exposure to air at interior and exterior ambient temperatures and a non-metallic thermal barrier member interlockingly engaged with said interior and exterior metal frame members and disposed therebetween and joining together said metal frame members and thermally insulating said metal frame members from each other; and first and second sashes or panels in lapping relation within said outer frame and said sashes or panels being disposed in inboard and outboard relation to the median of said thermal barrier member, at least one of said sashes or panels being movable in parallel relation to the other of said sashes or panels for opening and closing the window or door, each of said sashes or panels including an insulated glass panel and a continuous outer metal frame extending along and embracing the periphery of said glass panel, a thermal barrier means mounted on said outer frame and inwardly thereof and on a line extending between said sashes or panels, a non-metallic thermal barrier interlock member lockedly engaged on the metal frame of one of said sashes or panels and disposed between said metal frame of said one of said sashes or panels and the metal frame of the other of said sashes or panels, said non-metallic thermal barrier members in said outer frame, said thermal barrier means mounted on said outer frame and said non-metallic thermal barrier interlock member on said metal frame of said one of said sashes or panels providing a complete thermal barrier between all metal frame members of the assembly which are exposed to the interior environment and all metal frame members which are exposed to the exterior environment.

13. A window or door assembly according to claim 12, wherein said non-metallic thermal barrier members in said outer frame and said thermal barrier means mounted on said outer frame are combined as single unitary plastic shapes.

* * * * *

UNITED STATES PATENT AND TRADEMARK OFFICE

CERTIFICATE OF CORRECTION

PATENT NO. : 4,151,682

DATED : May 1, 1979

INVENTOR(S) : DIETRICH F. SCHMIDT

It is certified that error appears in the above-identified patent and that said Letters Patent is hereby corrected as shown below:

Column 15, line 66, reads "ing thermally non-conductive barrier extending mate-", should read -- ing thermally non-conductive barrier mate- --.

Signed and Sealed this

*Twenty-fifth* Day of *September 1984*

[SEAL]

*Attest:*

GERALD J. MOSSINGHOFF

*Attesting Officer*

*Commissioner of Patents and Trademarks*